US006619222B1

(12) United States Patent
Clary

(10) Patent No.: US 6,619,222 B1
(45) Date of Patent: Sep. 16, 2003

(54) REVERSIBLE AND ADJUSTABLE BOAT BUMPERS

(76) Inventor: Thomas W. Clary, P.O. Box 185, Hwy. 71 North, Milford, IA (US) 51351

( * ) Notice: Subject to any disclaimer, the term of this patent is extended or adjusted under 35 U.S.C. 154(b) by 0 days.

(21) Appl. No.: 10/150,323

(22) Filed: May 16, 2002

(51) Int. Cl.[7] ..... B63B 59/02
(52) U.S. Cl. ..... 114/219
(58) Field of Search ..... 114/219; 405/212–215

(56) References Cited

U.S. PATENT DOCUMENTS 5,018,471 A 5/1991 Stevens
5,184,562 A 2/1993 Hallin
5,562,364 A 10/1996 Darder-Alomar
6,053,664 A 4/2000 Crane et al.
6,349,661 B1 * 2/2002 Dusek ..... 114/219

* cited by examiner

*Primary Examiner*—Jesus D. Sotelo
(74) *Attorney, Agent, or Firm*—McKee, Voorhees & Sease, P.L.C.

(57) ABSTRACT

A reversible boat bumper for attachment to dock poles to allow accommodation for a high water position and a low water position. The bumper has an elongated bumper support plate and attached to it a bumper cushion. A pair of spaced apart releasable gripping dock brackets are attached to the side of the support plate opposite the bumper cushion, with a bracket being positioned adjacent one end and another approximately at mid-point along the elongated support plate.

18 Claims, 3 Drawing Sheets

REVERSIBLE AND ADJUSTABLE BOAT BUMPERS

FIELD OF THE INVENTION

The present invention relates to docks and particularly lake docks.

BACKGROUND OF THE INVENTION

Lake docks typically involve a plurality of spaced apart support poles holding a dock platform with an upper surface. The support poles extend from the platform down to engage the bottom of the lake. There are many different configurations of dock poles, e.g. square in cross section, round in cross section, wood poles, steel poles, etc. All of these variety of poles work adequately for their dock surface support function. However, whether the poles are wood, steel, round in cross section, square in cross section or for that matter rectangular in cross section, they all have one common problem, i.e. boats landing adjacent the dock will bang their hull against the dock poles. This can cause significant damage to the boat hull, and to the dock as well. Commonly this problem is solved by using portable boat bumpers. Boaters throw these over the side to prevent the boat from slamming into the dock. As an alternative, at least some docks have bumpers attached to the dock support poles. Either way can work satisfactorily. Having actual bumpers attached to the dock support poles is preferred since not all boats have portable boat bumpers.

As those familiar with fresh water lakes know, the lake height can vary significantly from spring to fall. For example, variances of up to three feet are not at all unusual, depending upon the particular fresh water lake involved. This creates difficulty with dock bumpers if they are installed initially at high water levels in the spring. Often by mid-summer, the bumpers are not at a level that they offer any further protection at all.

As can be seen, there is therefore a continuing need for the development of an extremely simple adjustment to allow dock bumpers to accommodate fresh water lakes at high, medium and low water levels. This invention has as its principal object, the development of a bumper system which is reversible, i.e. can simply be turned over and attached one way to accommodate high water and turned back the other way to accommodate low water.

Importantly, the system is one which uses a minimum of parts and therefore can be quickly and easily adjusted without worry of degradation from constant water exposure.

Also, designed for optional use with the system is a flag pole holder which can be used to hold a flag, if the dock owner desires. In fact, it can be used to hold the flag whether the boat bumpers are in the high water position or the reversible low water position.

BRIEF SUMMARY OF THE INVENTION

A reversible boat bumper for attachment to dock poles which can be reversed from a high water position, typically in the spring of the year, to a low water position usable typically in mid-summer to late-summer. The bumper system has an elongated bumper support plate with top and bottom ends and front and rear facing surfaces. An elongated bumper cushion is attached to the front facing surface of the support plate. Opposed to this, on the back facing surface of the plate, are releasable grip dock brackets, with one attached approximately adjacent to top end of the elongated bumper support plate and the other attached approximately at mid-point along the bumper surface. Optionally, the unit can have a flag support holder attached to the adjustable brackets. The bumper or cushion is preferably polymeric plastic material and may be foamed or non-foamed plastic material, but is always compressible to absorb impact whether foamed or not foamed.

DETAILED DESCRIPTION OF THE PREFERRED EMBODIMENTS

Figure 3:
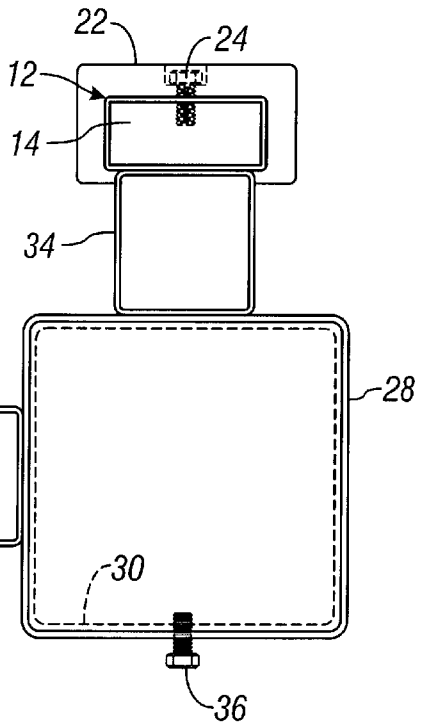
FIG. 3 is a plan view of a corner bumper unit of FIG. 4.
Figure 2:
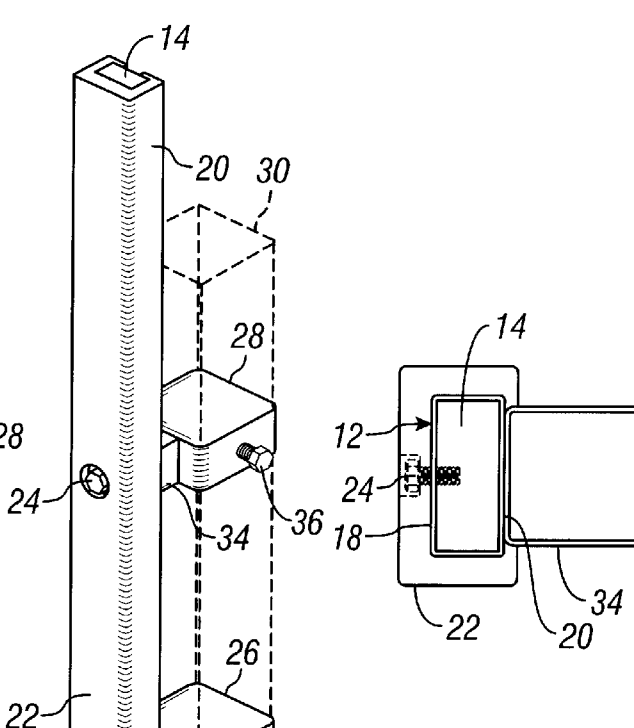
FIG. 2 is a perspective view of one bumper system unit of this invention.
Figure 1:
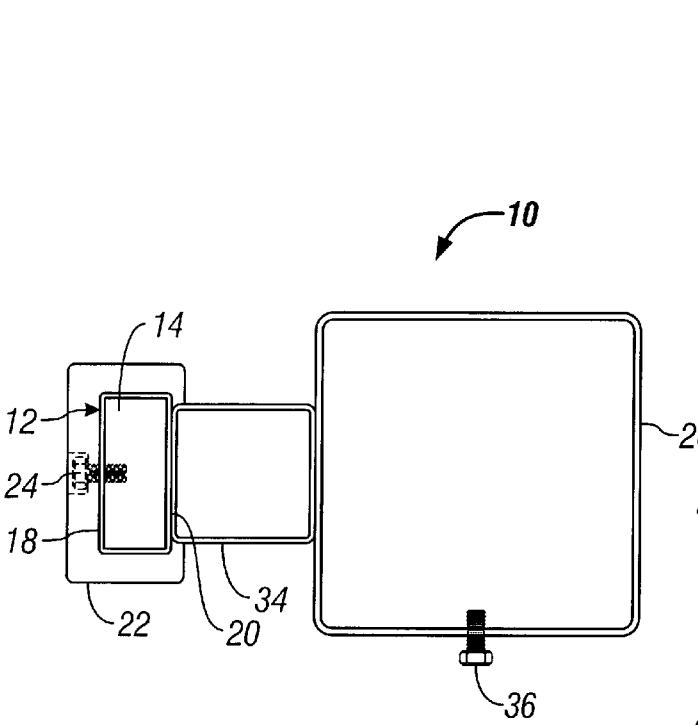
FIG. 1 is a plan view of the bumper unit of FIG. 2.
Figure 6:
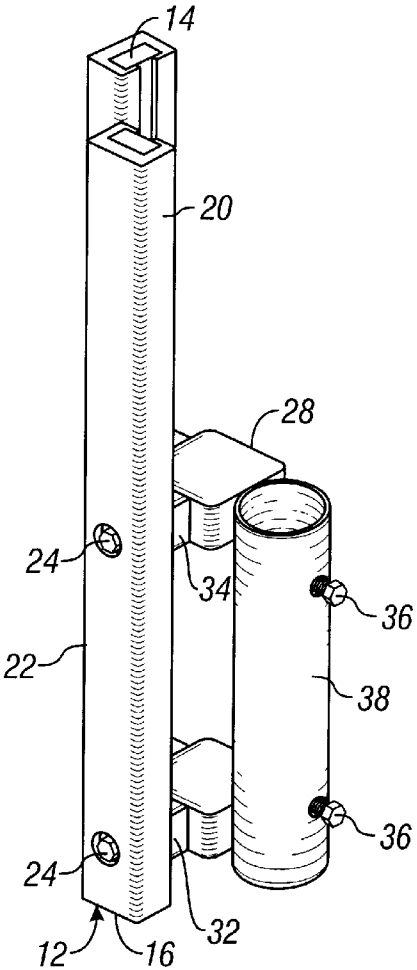
FIG. 6 shows a perspective view of the unit of FIG. 5.
Figure 5:
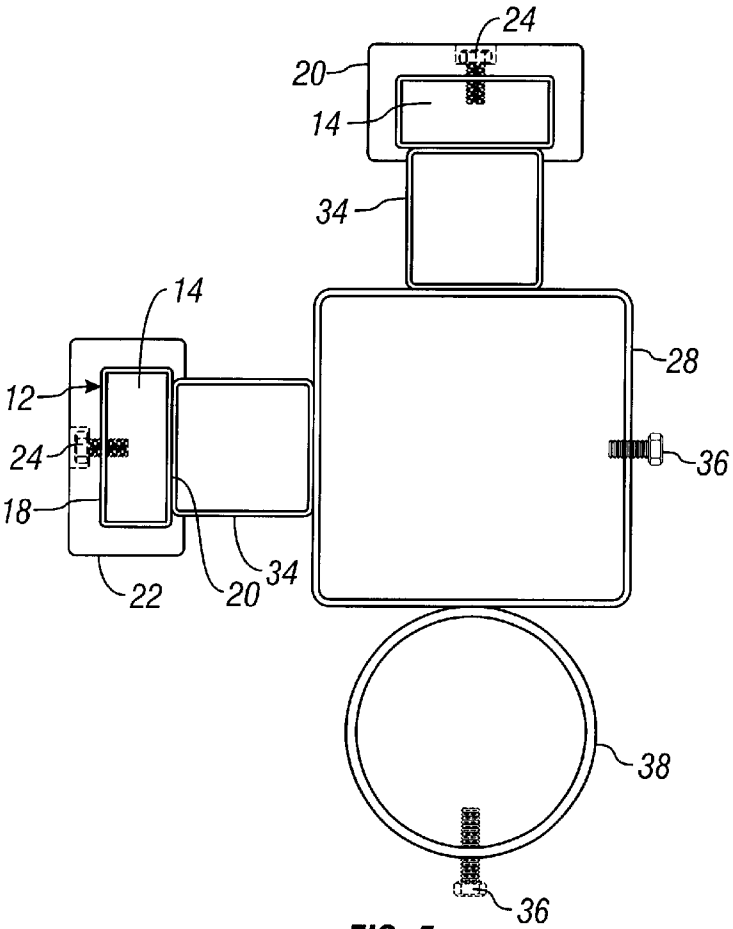
FIG. 5 shows a plan view of a corner bumper unit that also has a flag holder.

The present invention, a reversible boat bumper, is generally referred to in the drawings at numeral 10. It can be seen that it is generally comprised of an elongated bumper support plate 12 having top and bottom ends 14, 16 respectively, and front and rear facing surfaces 18, and 20. An elongated bumper cushion 22 is attached in generally laminar relationship to the bumper support plate 12. As illustrated, it is attached by bolts 24. Attached to the rear facing surface 20 of bumper support plate 12 are a pair of spaced apart brackets 26 and 28. As depicted, these brackets are square in configuration but, of course, could be round. The only important criteria is that brackets 26 and 28 correspond in configuration to the cross section of dock poles 30. Also as depicted, they are attached to the rear surface of bumper support plate 12 by welded straps 32 and.34 respectively. Their location along plate 12 is important to allow for the accommodation of the dock system being reversible for high and low water, as explained below. In particular, bracket 26 is adjacent the top end surface and bracket 28 is located approximately at a mid-point on bumper support plate 12. Set screws 36 can be used to make the bracket releasably grip dock pole 30.

Figure 4:
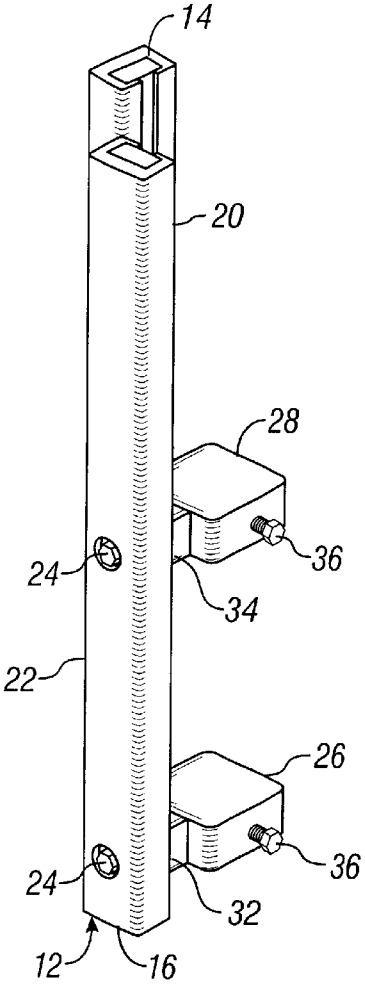
FIG. 4 is a perspective view of a corner bumper unit.
Figure 10:
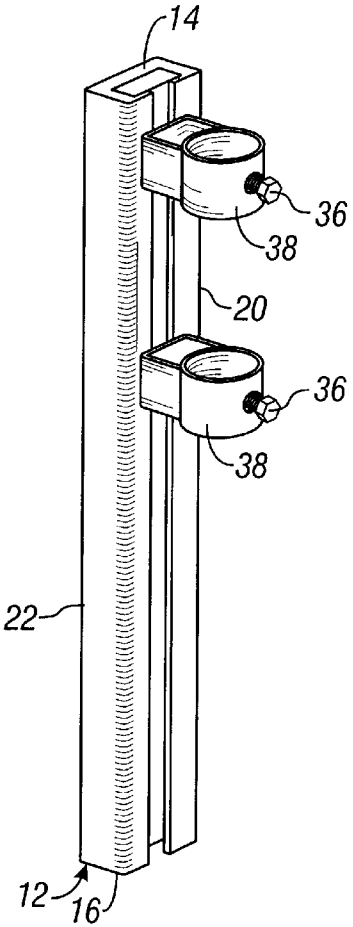
FIG. 10 shows the unit of FIG. 9 in perspective.
Figure 9:
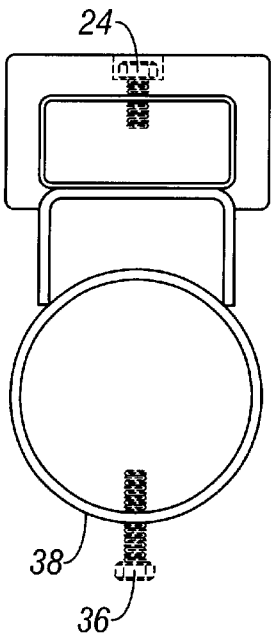
FIG. 9 shows a round bracket single bumper unit.
Figure 8:
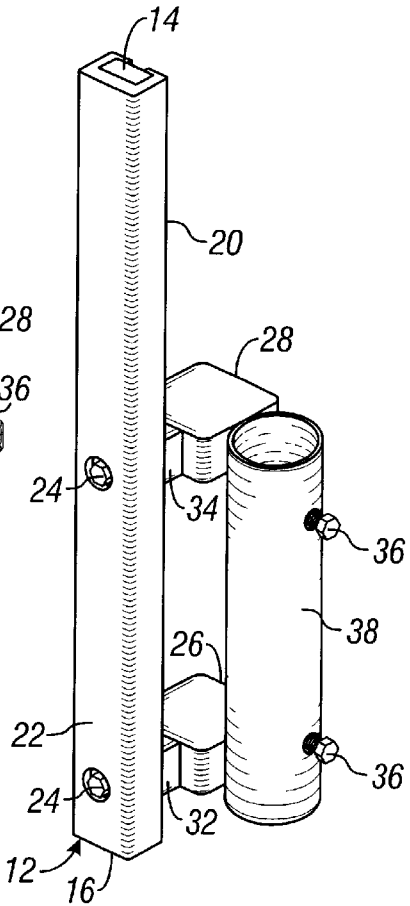
FIG. 8 shows a perspective view of the unit of FIG. 7.
Figure 7:
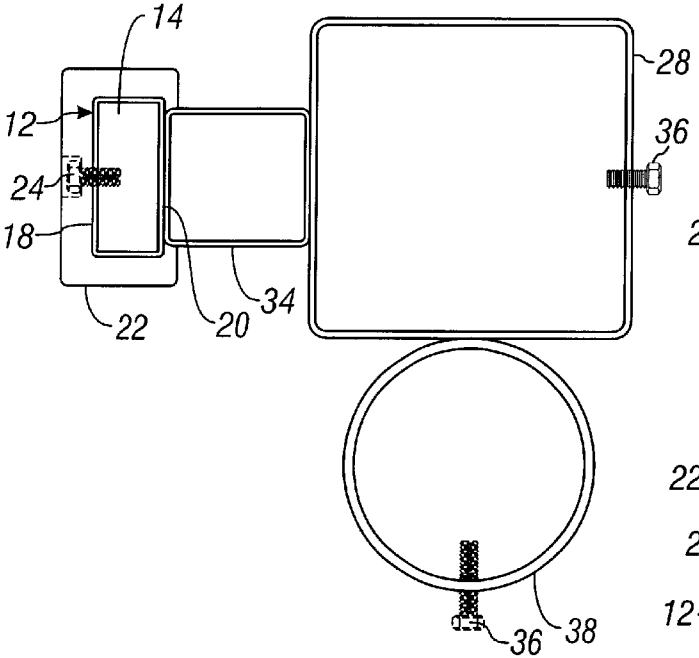
FIG. 7 shows a plan view of a single bumper unit with a flag pole holder.

Optionally, the unit may contain a flag pole holder 38 attached to each of the-brackets 26 and 28 (see FIGS. 7 and 8). Also optionally, as illustrated in FIGS. 3 and 4, a second bumper support plate 12 may be attached to another portion of brackets 26 and 28 to allow accommodation for corner cushioning.

In actual operation, the reversible boat bumper works as follows. In times of low water, the unit is used with the top end 14 positioned downward so that mid-point bracket 28 is first inserted over pole 30 followed by bottom bracket 26. The units are set at the proper height with the portion of cushion 22 adjacent top 14 extending down towards the water, and perhaps even into the water. At high water where the long downwardly extending part of the cushion is not needed, the pole is reversed so that bracket 28 is at the top and bracket 26 at the bottom near the water surface. As can be seen because of the configuration of the flag pole holder 38, it works in either direction.

Certain constructional features are worthy of mention. Brackets 26 and 28 are necessarily configured to fit snugly around the perimeter of dock pole 30. They may be rectangular, square or circular in shape, depending on the shape of the cross-section of dock pole 30. The boat cushion, or bumper material 22, is a polymeric plastic material.

For most embodiments and applications of the present invention wherein a bumper is foamed material, the solid of the foam material is preferably a synthetic polymer or rubber. There are many conventionally known foam materials in this category, such materials being variously and generally interchangeably described as "plastic foams," "foamed plastics," "cellular polymers" and "expanded plastics." Varieties of other kinds and categories of foam materials, e.g., glass foams, ceramic foams and metal foams, are also conventionally known, and may be approximately or preferably used for a given embodiment or application in practicing this invention.

The ordinarily skilled artisan is acquainted with the various types of foam material and their characteristics, and is capable of selecting a foam material which may be approximately or preferably used as internal bumper contents in practicing any of the multifarious embodiments and applications of the present invention. See, e.g., Grayson, Martin, *Encyclopedia of Composite Materials and Components,* John Wiley & Sons, New York, 1983, "Foamed Plastics," pages 530–574; Lubin, George, *Handbook of Composites,* Van Nostrand Reinhold Company, New York, 1981, glossary (e.g., "foamed plastics," page 763); Brady, George S., Clauser, Henry R., Materials Handbook, McGraw-Hill, Inc., New York, 1991, pages 341–351 I("foam materials"); Lee, Stuart M., *Dictionary of Composite Materials Technology*, Technomic Publishing Co., Inc., Lancaster, Pa., 1989, e.g., page 61 ("foams").

It also goes without saying that the adjustable fasteners may be varied and need not be set screws as illustrated at 36; likewise the fasteners 24 for fastening the cushion material to the support plate 12, need not be bolts but could be other fastening means such as adhesive, etc.

What is claimed is:

1. A reversible boat bumper for attachment to dock poles in at least a high water position and a low water position, comprising:

an elongated bumper support plate having top and bottom ends, and front and rear facing surfaces;

an elongated bumper cushion attached to said front facing surface;

at least a pair of spaced apart releasable gripping dock brackets, attached to the rear facing surface of said support plate; and said brackets being attached adjacent the top end and approximately in the center of said support plate.

2. The boat bumper of claim 1 wherein the releasable grip of the dock brackets is a set screw adjustment.

3. The boat bumper of claim 1 which has a flag pole holder attached to the releasable grip dock brackets.

4. The boat bumper of claim 1 where the bumper cushion is plastic.

5. The boat bumper of claim 4 wherein the bumper cushion is polymeric, compressible plastic.

6. The boat bumper of claim 5 wherein the bumper cushion is foamed polymeric, compressible plastic.

7. The boat bumper of claim 6 wherein the brackets are attached to allow the bumper support plate to be moveable between a high water position and a low water position.

8. The boat bumper of claim 7 wherein the bumper support plate when in the high water position has an upwardly extending portion of the elongated bumper cushion.

9. The boat bumper of claim 7 wherein the bumper support plate when in the low water position has a downwardly extending portion of the elongated bumper cushion.

10. A reversible boat bumper for attachment to dock poles in at least a high water position and a low water position, comprising:

an elongated bumper support plate having top and bottom ends, and front and rear facing surfaces;

an elongated bumper cushion attached in generally laminar relationship to said front facing surface;

at least a pair of spaced apart releasable gripping dock brackets, attached to the rear facing surface of said support plate; and said brackets being attached adjacent the top end and approximately in the center of said support plate.

11. The boat bumper of claim 10 wherein the brackets are attached to allow the bumper support plate to be moveable between a high water position and a low water position.

12. The boat bumper of claim 11 wherein the bumper support plate when in the high water position has an upwardly extending portion of the elongated bumper cushions.

13. The boat bumper of claim 11 wherein the bumper support plate when in the low water position has a downwardly extending portion of the elongated bumper cushions.

14. The boat bumper of claim 10 which has a flag pole holder attached to the releasable grip dock brackets.

15. The boat bumper of claim 10 which has a flag pole holder attached to the reasonable grip dock brackets.

16. A reversible boat bumper for attachment to dock poles in at least a high water position and a low water position, comprising:

an elongated bumper support plate having top and bottom ends, and front and rear facing surfaces;

an elongated bumper cushion attached to said front facing surface;

at least a pair of spaced apart releasable gripping dock brackets, attached to the rear facing surface of said support plate;

said brackets being attached adjacent the top end and approximately in the center of said support plate; and said elongated bumper support plate moveable between a high water position and a low water position.

17. The boat bumper of claim 16 wherein the bumper support plate when in the high water position protects a boat at a medium water position.

18. The boat bumper of claim 16 wherein the bumper support plate when in the low water position protects a boat at a medium water position.

* * * * *